US007094161B2

(12) United States Patent
Endou

(10) Patent No.: US 7,094,161 B2
(45) Date of Patent: Aug. 22, 2006

(54) GOLF BALL

(75) Inventor: Seiichirou Endou, Kobe (JP)

(73) Assignee: SRI Sports Limited, Kobe (JP)

( * ) Notice: Subject to any disclaimer, the term of this patent is extended or adjusted under 35 U.S.C. 154(b) by 65 days.

(21) Appl. No.: 10/051,085

(22) Filed: Jan. 22, 2002

(65) Prior Publication Data

US 2002/0187856 A1 Dec. 12, 2002

(30) Foreign Application Priority Data

Feb. 5, 2001 (JP) ..... 2001-027676

(51) Int. Cl.
*A63B 37/12* (2006.01)

(52) U.S. Cl. ..... 473/378

(58) Field of Classification Search ..... 473/378–385, 473/371, 367, 368, 376, 377
See application file for complete search history.

(56) References Cited

U.S. PATENT DOCUMENTS 4,729,567 A * 3/1988 Oka et al. ..... 473/384
5,078,402 A * 1/1992 Oka ..... 473/380
5,601,503 A * 2/1997 Yamagishi et al. ..... 473/384
5,776,013 A * 7/1998 Yokota et al. ..... 473/377

FOREIGN PATENT DOCUMENTS

| | | |
|---|---|---|
| JP | 06-319831 | 11/1994 |
| JP | 10-248958 | * 9/1998 |
| JP | 11-128403 | 5/1999 |
| WO | 98/47573 | 10/1998 |

* cited by examiner

*Primary Examiner*—Raeann Gorden
(74) *Attorney, Agent, or Firm*—Birch, Stewart, Kolasch, Birch, LLP

(57) ABSTRACT

Golf ball 1 includes a core 2 formed by crosslinking a rubber composition and a cover 3 comprising a resin composition. The cover 3 has a two-layered structure including an outer cover layer 4 and an inner cover layer 5. A number of dimples 6 are formed on the surface of the cover 3. The outer cover layer 4 has a Shore D hardness of from 58 to 72. The golf ball 1 has an amount of compressive deformation of from 2.5 mm to 4.0 mm when measured with applying an initial load of 10 kgf to a final load of 130 kgf. Percentage of the number of dimples having a contour length of greater than or equal to 11.6 mm occupied in total number of dimples is greater than or equal to 50%.

10 Claims, 1 Drawing Sheet

GOLF BALL

BACKGROUND OF THE INVENTION

1. Field of the Invention

The present invention relates to golf balls, and more particularly, to solid golf balls including a core comprising a crosslinked rubber, and a cover comprising a resin composition.

2. Description of the Related Art

Golf balls used for playing golf at a golf course are generally classified as: wound golf balls having a core comprising wound rubber threads; and solid golf balls (two-piece golf balls, three-piece golf balls, and the like) having a core comprising a solid rubber. Wound golf balls have been conventionally used, with a period through which wound golf balls account for almost all of the first-class golf balls. However, solid golf balls that have been developed afterwards can be readily manufactured at a lower cost, therefore, larger number of solid golf balls have been recently supplied to the market than the wound golf balls. In general, feel at impact of the wound golf ball is soft, and thus, among the professional golfers as well as the senior-class amateur golfers, there still exist strong needs for the wound golf balls that are excellent in feel at impact in spite of the current status where solid golf balls prevail at the market.

Meanwhile, various attempts have been made to improve feel at impact and a travel distance of solid golf balls (for example, see Japanese Patent Publication References H6-319831/1994, H10-248958/1998, H11-128403/1999, 2000-512881, and the like). In recent years, solid golf balls have been developed, which exhibit feel at impact nearly as soft as that of wound golf balls.

In the meantime, USGA (United States Golf Association) has defined a rule for an initial velocity of a golf ball. In accordance with this rule, the initial velocity of a golf ball as measured with a flywheel initial velocity measuring machine under a predetermined condition should not be higher than 255 ft/s. The golf balls out of this order cannot be officially approved by USGA, which are not accepted for use in official games all over the world.

USGA also defines a rule of ODS. In accordance with this rule, a travel distance of a golf ball should be equal to or less than 280 yards when hit with a predetermined condition. The golf balls out of this order cannot be officially approved by USGA, which are not accepted for use in official games all over the world.

A golf ball is hit by an impact with a golf club. The initial velocity upon the hit does not necessarily correlate to the initial velocity according to a flywheel method. In particular, solid golf balls, of which feel at impact being nearly as soft as wound golf balls, tend to represent high initial velocity according to a flywheel method despite the fact that the actual velocity is not that high upon the hit by a golf club. In view of the observance of USGA rules, golf ball manufacturers may intentionally use materials that provide inferior resilience performance with the solid golf ball having soft feel. When such a golf ball is hit by a golf club, tendencies to result in lower initial velocity, lower launch angle, larger backspin speed, and the like are exhibitted. Consequently, sufficient travel distance may not be achieved. Especially, insufficient travel distance is apt to be achieved when golfers who are playing with a lower club-head speed (e.g., woman golfers and average golfers) hit the ball.

Apart from the golfers who play in official games, many ordinary golfers play golf for their pleasure. These ordinary golfers desire golf balls having excellent flight performance, which allow pleasant game playing accordingly. For such ordinary golfers, it is not that important concern whether the golf balls conform to USGA rules or not.

The present invention was accomplished in light of such circumstances, and the object of the present invention is directed to provide solid golf balls having soft feel at impact, and an excellent resilience performance and an excellent flight performance.

SUMMARY OF THE INVENTION

An aspect of the present invention to achieve the object described above is: a golf ball including a core comprising one or more layers formed by crosslinking a rubber composition, and a cover comprising one or more layers formed from a resin composition, wherein said golf ball has:

an amount of compressive deformation of from 2.5 mm to 4.0 mm when measured with applying an initial load of 10 kgf to a final load of 130 kgf;

a Shore D hardness of the outermost layer of said cover being from 58 to 72; and a percentage of the number of dimples having a contour length of greater than or equal to 11.6 mm occupied in total number of numerous dimples formed over the surface thereof of greater than or equal to 50%.

This golf ball is compatible with both soft feel at impact and an excellent resilience performance due to a predetermined amount of compressive deformation and a predetermined hardness of the outermost layer of the cover. In addition, this golf ball affords a long travel distance owing to a synergistic effect of: an excellent resilience performance; an elevated launch angle; a moderate spin performance; and a superior aerodynamic property exerted by the dimples.

The amount of compressive deformation of the core preferably is in the range from 3.0 mm to 6.0 mm when measured with applying an initial load of 10 kgf to a final load of 130 kgf. Softer feel at impact and more excellent resilience performance may be thereby accomplished.

Preferably, at least one layer of the core is formed by crosslinking a rubber composition comprising: 100 parts by weight of a base rubber predominantly containing polybutadiene, from 15 parts to 40 parts by weight of a co-crosslinking agent predominantly containing a zinc salt or magnesium salt of acrylic acid or methacrylic acid; from 0.1 parts to 3.0 parts by weight of an organic peroxide; and from 0.1 parts to 1.5 parts by weight of a sulfur compound. Such a core is responsible for the excellent feel at impact and the resilience performance. Preferred sulfur compounds are disulfides, thiophenols or thiocarboxylic acids, or metal salts thereof.

Preferably, the initial velocity according to a flywheel method of the golf ball of the present invention, which was measured pursuant to USGA rules, is greater than or equal to 255.0 ft/s. Further, a total distance of the golf ball measured pursuant to ODS rules of USGA is greater than or equal to 285 yards.

The present invention is hereinafter described in detail with appropriate references to the accompanying drawing according to the preferred embodiments of the present invention.

DESCRIPTION OF THE PREFERRED EMBODIMENTS

Figure 1:
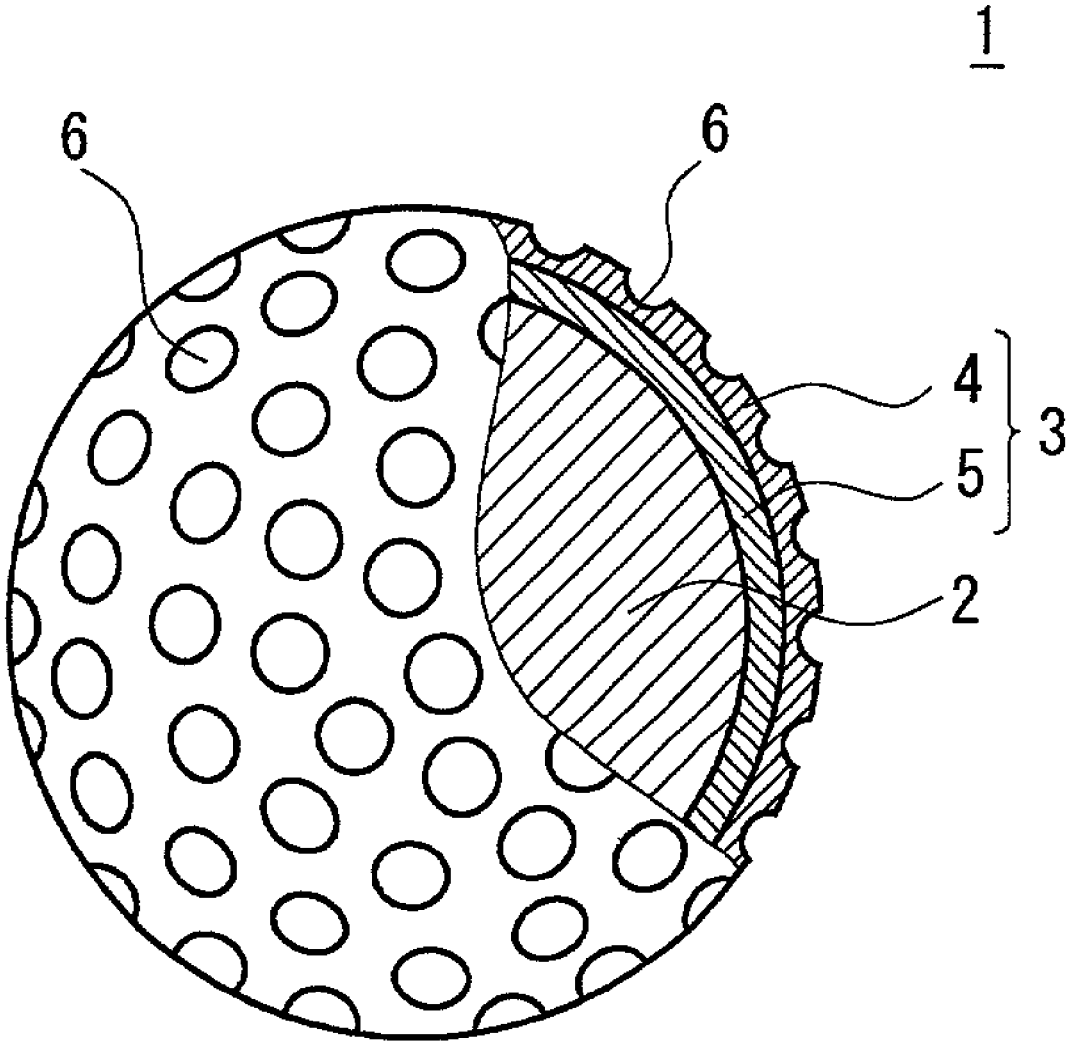
FIG. 1 is a schematic view of a golf ball according to one embodiment of the present invention illustrating a partially cut off cross-section.

A golf ball depicted in FIG. 1 has a core 2 formed by crosslinking a rubber composition, and a cover 3 comprising a resin composition. The cover 3 has a two-layered structure including an outer cover layer 4 and an inner cover layer 5. Numerous dimples 6 are formed on the surface of the cover 3. This golf ball 1 has a paint layer and a mark layer on the outer surface of the cover, although not shown in the FIGURE. The golf ball 1 usually has an external diameter of from 42 mm to 43 mm, and in particular, from 42.67 mm to 42.85 mm. Further, this golf ball 1 usually has a weight of from 44 g to 46 g, and in particular, from 45.00 g to 45.93 g.

A base rubber for the rubber composition for use in the core 2 suitably includes polybutadienes, polyisoprenes, styrene-butadiene copolymers, ethylene-propylene-diene copolymers (EPDM), natural rubbers and the like. Two or more kinds of these rubbers may be used in combination. In view of the resilience performance, polybutadienes are preferred. To predominantly employ a polybutadiene is preferred even where another rubber is used in combination with a polybutadiene. More specifically, it is preferred that the percentage of the polybutadiene in total base rubber is greater than or equal to 50 weight %, and in particular, greater than or equal to 80 weight % of polybutadiene occupied in total weight of the base rubber. Among polybutadienes, high cis-polybutadienes are preferred, which have a percentage of cis-1,4 bond of greater than or equal to 40%, in particular, greater than or equal to 80%.

The mode of the crosslinkage in the core 2 is not particularly limited, however, in view of the resilience performance, using a divalent or trivalent metal salt of α,β-unsaturated carboxylic acid as a co-crosslinking agent is preferred. Illustrative examples of the preferred co-crosslinking agent include zinc acrylate, magnesium acrylate, zinc methacrylate, magnesium methacrylate, and the like. In particular, zinc acrylate is preferred which can result in high resilience performance.

The amount of the co-crosslinking agent to be blended is preferably in the range from 15 parts to 40 parts by weight per 100 parts by weight of the base rubber. When the amount to be blended is below the range described above, the core 2 may be so soft that insufficient resilience performance may be achieved. In this respect, the amount to be blended is preferably greater than or equal to 16 parts by weight, and particularly preferably greater than or equal to 20 parts by weight. When the amount to be blended is beyond the range described above, the core 2 may be so hard that soft feel at impact can not be experienced. In this respect, the amount to be blended is preferably less than or equal to 38 parts by weight, and particularly preferably less than or equal to 35 parts by weight.

In the rubber composition for use in the core 2, an organic peroxide may be preferably blended. The organic peroxide serves as a crosslinking agent in conjunction with the above-mentioned metal salt of α,β-unsaturated carboxylic acid, and also serves as a curing agent. By blending the organic peroxide, the resilience performance of the core 2 may be improved. Suitable organic peroxide includes dicumyl peroxide, 1,1-bis(t-butylperoxy)-3,3,5-trimethylcyclohexane, 2,5-dimethyl-2,5-di(t-butylperoxy)hexane, di-t-butyl peroxide, and the like. Particularly versatile organic peroxide is dicumyl peroxide.

The amount of the organic peroxide to be blended is preferably in the range from 0.1 parts to 3.0 parts by weight per 100 parts by weight of the base rubber. When the amount to be blended is below the range described above, the core 2 may be so soft that insufficient resilience performance may be achieved. In this respect, the amount to be blended is preferably greater than or equal to 0.2 parts by weight, and particularly preferably greater than or equal to 0.5 parts by weight. When the amount to be blended is beyond the range described above, the core 2 may be so hard that soft feel at impact can not be experienced. In this respect, the amount to be blended is preferably less than or equal to 2.8 parts by weight, and particularly preferably less than or equal to 2.5 parts by weight.

It is preferable that a sulfur compound is blended in the rubber composition for use in the core 2. By blending the sulfur compound, the resilience performance of the core 2 may be improved. Suitable sulfur compound includes disulfides, thiophenols and thiocarboxylic acids, and metal salts thereof may be suitably employed. Two or more kinds of sulfur compounds may be used in combination. Particularly suitable sulfur compounds include diphenyl disulfide and bis-pentachlorophenyl disulfide.

The amount of the sulfur compound to be blended is preferably in the range from 0.1 parts to 1.5 parts by weight per 100 parts by weight of the base rubber. When the amount to be blended is below the range described above, the effect of blending is deteriorated, and thus insufficient resilience performance may be achieved. In this respect, the amount to be blended is preferably greater than or equal to 0.2 parts by weight, and particularly preferably greater than or equal to 0.5 parts by weight. When the amount to be blended is beyond the range described above, the core 2 may be too soft, and otherwise the resilience performance of the core 2 may be insufficient, which result from the inhibition of the crosslinking reaction by the sulfur compound. In this respect, the amount to be blended is preferably less than or equal to 1.2 parts by weight, and particularly preferably less than or equal to 1.0 parts by weight.

The rubber composition may be blended with a filler for adjusting density thereof, for example, inorganic salts such as zinc oxide, barium sulfate, calcium carbonate and the like; and highly dense metal powders such as tungsten powder, molybdenum powder and the like. The amount of these fillers to be blended is determined ad libitum so that the intended core density can be accomplished. The density of the core 2 is usually in the range from 1.05 to 1.25. Preferred filler is zinc oxide because it serves not only as an agent for adjusting density but also as a crosslinking activator.

Various additives such as anti-aging agents, coloring agents, plasticizers, dispersants, and the like may be blended at an appropriate amount to the rubber composition as needed.

The amount of compressive deformation of the core 2 is preferably in the range from 3.0 mm to 6.0 mm. In order to measure the amount of compressive deformation, the core 2 is interposed between two, upper and lower, steel plates, and thereafter an initial load of 10 kgf is applied against the upper steel plate downward. The load is gradually increased from this state, and finally reaches 130 kgf. The amount of deformation of the core 2 is thus measured from the state applied with the initial load to the state applied with the final load.

When the amount of compressive deformation of the core 2 is below the range described above, disadvantages may be drawn which involve excessively hard feel at impact of the golf ball 1, excessively low launch angle, back spin speed being excessively high, and the like. In this regard, the amount of compressive deformation is more preferably greater than or equal to 3.2 mm, and particularly preferably greater than or equal to 3.4 mm. When the amount of compressive deformation of the core 2 is beyond the range described above, insufficient resilience performance may be achieved, otherwise heavy feel at impact of the golf ball 1 may be experienced. In this respect, the amount of compressive deformation is more preferably less than or equal to 5.5 mm, and particularly preferably less than or equal to 5.0 mm.

Although the core 2 depicted in FIG. 1 has a single layer, two or more layers may constitute the core 2. In this instance, at least one layer among the two or more layers may be constituted from the rubber composition as described above. Besides, the identical rubber composition may be used for each of the layers of the core 2 having two or more layers, however, different rubber compositions are usually employed for the respective layers. In accordance with such a structure, a degree of freedom for designing the core 2 is improved, which involves the distribution of hardness, the distribution of weight and the like, and thereby making the optimization of the resilience performance, feel at impact, the spin performance and the like of the golf ball 1 possible.

The external diameter of the core 2 may be determined ad libitum to accommodate to the thickness of the cover described below. In case of the golf ball 1 having a cover 3 comprising a single layer, it is preferable that the core 2 has an external diameter ranging from 37.0 mm to 41.4 mm. When the external diameter is below the range described above, the resilience performance of the golf ball 1 becomes insufficient, and the feel at impact may be hard owing to the thickness of the cover being relatively great. In this respect, it is more preferable that the external diameter be greater than or equal to 37.4 mm, and particularly preferably be greater than or equal to 37.8 mm. When the external diameter is beyond the range described above, the thickness of the cover becomes relatively small, and thus forming of the cover may be difficult; and otherwise the feel at impact may be heavy. In this respect, the external diameter is more preferably less than or equal to 40.8 mm, and particularly preferably less than or equal to 40.3 mm.

In case of the golf ball 1 having a cover 3 comprising more than two layers, it is preferable that the external diameter of the core 2 is in the range from 32.5 mm to 40.0 mm. When the external diameter is below the range described above, the resilience performance of the golf ball 1 becomes insufficient, and the feel at impact may be hard owing to the thickness of the cover being relatively great. In this respect, it is more preferable that the external diameter is greater than or equal to 34.8 mm. When the external diameter is beyond the range described above, the thickness of the cover becomes relatively small, and thus forming of the cover may be difficult, otherwise the feel at impact may be heavy. In this respect, the external diameter is more preferably less than or equal to 38.0 mm.

Upon forming the core 2 comprising a single layer, a rubber composition is placed into a mold comprising upper and lower portion, each of which having a hemispherical cavity, and then the rubber composition is subjected to heating and pressurization. Accordingly, a crosslinking reaction is caused in the rubber composition to form a spherical core 2 (so called, compression molding). Of course, the core 2 may be formed by any molding techniques such as injection molding and the like.

When the core 2 comprising two layers is formed, a spherical inner layer is formed first by aforementioned compression molding, injection molding or the like. Next, the inner layer is covered by two half shells comprising a rubber composition. The inner layer and the half shells are then placed into a mold comprising upper and lower portion, each of which has a hemispherical cavity, and thereafter subjected to heating and pressurization. A crosslinking reaction is thereby caused in the rubber composition to form an outer layer. Of course, the outer layer may be formed by any molding techniques such as injection molding and the like.

An inner cover layer 5 (also referred to as an intermediate layer) is formed from a resin composition as described above. Suitable base polymers for use as the resin composition include ionomer resins. Of the ionomer resins, copolymers of α-olefin and α,β-unsaturated carboxylic acid having 3 to 8 carbon atoms in which part of carboxylic acid is neutralized with a metal ion are particularly suitable. As the α-olefin herein, ethylene and propylene are preferred. Acrylic acid and methacrylic acid are preferred as the α,β-unsaturated carboxylic acid. Metal ions for the neutralization include: alkaline metal ions such as sodium ion, potassium ion, lithium ion and the like; bivalent metal ions such as zinc ion, calcium ion, magnesium ion and the like; trivalent ions such as aluminum ion, neodymium ion and the like. The neutralization may also be carried out with two or more kinds of metal ions. In light of the resilience performance, durability and the like, particularly preferred metal ion is sodium ion, zinc ion, lithium ion and magnesium ion.

Illustrative examples of suitable ionomer resin include "Himilan 1555", "Himilan 1557", "Himilan 1601", "Himilan 1605", "Himilan 1652", "Himilan 1705", "Himilan 1706", "Himilan 1707", "Himilan 1855", "Himilan 1856", trade names by Mitsui-Dupont Polychemical Co. Ltd.; "Surlyn® 9945", "Surlyn® 8945", "Surlyn® AD8511", "Surlyn® AD8512", trade names by Dupont; and "IOTEK 7010", "IOTEK 8000", trade names by Exxon Corporation, and the like. Two or more ionomer resins may be used in combination.

As the resin composition for the inner cover layer 5, a thermoplastic elastomer (polymer including a soft segment and a hard segment) may be used alone or in conjunction with the ionomer resin. In other words, "resin composition" of the present invention also includes those comprising a thermoplastic elastomer as a base thereof.

Exemplary thermoplastic elastomers that can be used include thermoplastic polyurethane elastomers, thermoplastic polyamide elastomers, thermoplastic polyester elastomers, thermoplastic styrene elastomers, thermoplastic elastomers having a hydroxyl (OH) group at their ends, and the like. Two or more thermoplastic elastomers may be used in combination. In light of the resilience performance, thermoplastic polyester elastomers and thermoplastic styrene elastomers are particularly suitable.

Thermoplastic styrene elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, hydrogenated SIBS, and the like. Exemplary hydrogenated SBS include styrene-ethylene-butylene-styrene block copolymers (SEBS). Exemplary hydrogenated SIS include styrene-ethylene-propylene-styrene block copolymers (SEPS). Exemplary hydrogenated SIBS include styrene-ethylene-ethylene-propylene-styrene block copolymers (SEEPS).

Illustrative examples of thermoplastic polyurethane elastomers include "Elastolan", trade name by Takeda Badisch Urethane Ind. Co., Ltd., and more specifically, "Elastolan ET880" can be exemplified. Illustrative examples of thermoplastic polyamide elastomers include "Pebax®", trade name by Toray Industries, Inc., and more specifically, "Pebax® 2533" can be exemplified. Illustrative examples of thermoplastic polyester elastomers include "Hytrel®", trade name by Dupont-Toray Co., Ltd., and more specifically, "Hytrel® 3548" and "Hytrel® 4047" can be exemplified. Illustrative examples of thermoplastic styrene elastomers include "Rabalon®", trade name by Mitsubishi Chemical Corporation, and more specifically, "Rabalon® SR04" can be exemplified.

To the resin composition of the inner cover layer 5, diene block copolymers may be blended in combination with the ionomer resin or the thermoplastic elastomer. A diene block copolymer comprises a polymer block of which basis being at least one vinyl aromatic compound, and a polymer block of which basis being at least one conjugated diene compound. The diene block copolymer has a double bond derived from the conjugated diene compound. Partially hydrogenated diene block copolymers may also be used suitably.

Exemplary vinyl aromatic compounds that constitute the block copolymer include styrene, α-methylstyrene, vinyltoluene, p-t-butylstyrene, 1,1-diphenylstyrene and the like, and one or more kinds are selected from these. Particularly, styrene is suitable. Further, exemplary conjugated diene compounds are butadiene, isoprene, 1,3-pentadiene, 2,3-dimethyl-1,3-butadiene and the like, and one or more kinds are selected from these. Specifically, butadiene, isoprene, and a combination thereof are suitable.

Preferable diene block copolymers include: those of which structure being SBS (styrene-butadiene-styrene) having a polybutadiene block containing epoxy groups; those of which structure being SIS (styrene-isoprene-styrene) having a polyisoprene block containing epoxy groups; and the like. Illustrative examples of diene block copolymer include "Epofriend®", trade name by Daicel Chemical Industries, Ltd., and more specifically, "Epofriend® A1010" can be exemplified.

The density of the inner cover layer 5 is usually in the range from approximately 0.8 to 1.2. By blending the filler, the density of the inner cover layer 5 may be adjusted. Exemplary filler includes inorganic salts such as zinc oxide, barium sulfate, calcium carbonate and the like; and highly dense metal powder such as tungsten powder, molybdenum powder and the like. The amount of these fillers to be blended is optionally determined so that the intended density of the inner cover layer 5 can be accomplished. When the filler is blended therein, the density of the inner cover layer 5 is usually in the range from 0.9 to 1.4.

The Shore D hardness of the inner cover layer 5 is preferably in the range from 20 to 67. When the Shore D hardness is below the range described above, the flight performance may be insufficient resulting from deteriorating the resilience performance of the golf ball 1 or excessive spin speed. When the Shore D hardness is beyond the range described above, hard feel at impact may be experienced. The Shore D hardness is measured using the identical method to the method of measuring the Shore D hardness of the outer cover layer 4 as described below.

The inner cover layer 5 is formed by placing a core 2 into a mold comprising upper and lower portion, each of which having a hemispherical cavity, and then injecting a resin composition, which was melted by heating, around the core 2. The inner cover layer 5 may be formed by compression molding through use of two half shells made from the material for the inner cover layer 5.

As described above, the outer cover layer 4 is also formed from a resin composition. As a base polymer for the resin composition, additionally, a similar ionomer composition for use in the inner cover layer 5 described above is preferred, otherwise, similar thermoplastic elastomer or diene block copolymer for use in the inner cover layer 5 may be used in combination with the ionomer resin.

Various additives for example, fillers such as barium sulfate and the like, coloring agents such as titanium dioxide and the like, dispersants, anti-aging agents, ultraviolet absorbers, light stabilizers, fluorescent agents, fluorescent bleaching agents, pigments, and the like may be blended at an appropriate amount in the resin composition for the outer cover layer 4 as needed.

The Shore D hardness of the outer cover layer 4 is in the range from 58 to 72. When the Shore D hardness is below the range described above, disadvantages may be drawn which involve insufficient resilience performance of the golf ball 1, excessively low launch angle, excessively high back spin speed, and the like. In this respect, the Shore D hardness is preferably greater than or equal to 61. When the Shore D hardness is beyond the range described above, hard feel at impact of the golf ball 1 may be experienced. In this respect, the Shore D hardness is preferably less than or equal to 70. The Shore D hardness is measured with a Shore D type spring hardness scale in conformity to ASTM-D224 rules. For the measurement, sheets having a thickness of 2.0 mm are used, which were formed by a hot press process with a resin composition identical to that for the outer cover layer 4. These sheets are stored for two weeks under an atmosphere of 23° C. Then, three sheets are overlaid to measure the Shore D hardness. The sheets may be formed by melting the outer cover layer 4 that had been cut away from the golf ball 1, followed by resolidification.

The cover 3 of the golf ball 1 depicted in FIG. 1 has a two-layered structure comprising the outer cover layer 4 and the inner cover layer 5, however, the cover may be constituted with a single layer; alternatively, the cover may be constituted with three or more layers. In any case, the thickness of the outermost layer (the single layer itself being the outermost layer for a single-layered cover) preferably is in the range from 0.7 mm to 2.5 mm. When the thickness is below the range described above, disadvantages may be drawn which involve insufficient resilience performance, heavy feel at impact, difficulty in molding, and the like. In this respect, the thickness is preferably greater than or equal to 1.0 mm. When the thickness is beyond the range described above, hard feel at impact may be experienced. In this respect, the thickness is preferably less than or equal to 2.4 mm. The thickness of the outermost layer is measured at a land part, i.e., a part without any dimple 6.

When the cover 3 is constituted from two or more layers, all the layers may be formed from the identical resin composition, however, different resin compositions are usually employed for the respective layers. In accordance with such a structure, a degree of freedom for designing the distribution of hardness, the distribution of weight and the like of the cover 3 is improved, thereby making the optimization of the resilience performance, feel at impact, spin performance and the like of the golf ball 1 possible. Moreover, it is also possible that each role is divided to any of the layers; for example, the durability of the golf ball 1 may be represented in the outermost layer of the cover 3, while the feel at impact may be represented in another layer.

The amount of compressive deformation of the golf ball 1 is in the range from 2.5 mm to 4.0 mm. In order to measure the amount of compressive deformation, the golf ball 1 is interposed between two, upper and lower, steel plates, and thereafter an initial load of 10 kgf is applied against the upper steel plate downward. The load is gradually increased from this state, and finally reaches 130 kgf. The amount of deformation of the golf ball 1 is thus measured from the state applied with the initial load to the state applied with the final load.

When the amount of compressive deformation of the golf ball 1 is below the range described above, disadvantages may be drawn which involve excessively hard feel at impact, excessively low launch angle, back spin speed being excessively large, and the like. Further, the travel distance may be insufficient particularly when the golfers who are playing with a lower clubhead speed hit the golf ball 1. In this respect, the amount of compressive deformation is more preferably greater than or equal to 2.6 mm. When the amount of compressive deformation of the golf ball 1 is beyond the range described above, insufficient resilience performance may be achieved, otherwise heavy feel at impact of the golf ball 1 may be experienced. In this respect, the amount of compressive deformation is preferably less than or equal to 3.9 mm, and particularly preferably less than or equal to 3.5 mm.

The golf ball 1 having the core 2 and the cover 3 designed as described heretofore, achieves a high initial velocity. Preferably, the initial velocity (the initial velocity according to a flywheel method, which was measured pursuant to USGA rules) is greater than or equal to 255.0 ft/s.

As described herein above, the golf ball 1 has numerous dimples 6 on its surface. The plane shape of the dimple 6 (i.e., the contour of the dimple 6 observed by viewing the center of the golf ball 1 at infinity) is usually circular, however, non-circular shape (e.g., ellipsoid, oval, polygon, star, tear drops and the like) is also permitted. In addition, the sectional shape of the circular dimple 6 may be a single radius shape (i.e., circular-arc), or a double radius shape (i.e., dish-like). Total number of the dimples 6 is set to be in the range from 200 to 600 in general, particularly, from 360 to 450.

In view of the flight performance, it is preferable that numerous dimples having a longer contour length x are arranged. In particular, it is necessary that the percentage of the dimples having a contour length x greater than or equal to 11.6 mm (hereinafter also referred to as "dimples having a longer contour length") occupied in total number of the dimples (hereinafter also referred to as "percentage of dimples having a longer contour length") be greater than or equal to 50%. The percentage of the dimples having a longer contour length is preferably greater than or equal to 55%, and particularly preferably greater than or equal to 60%. By increasing the percentage of dimples having a longer contour length, the drag loaded to the golf ball 1 in-flight is speculated as being reduced.

The contour length x is a length that is measured along the outline of the dimple 6. For example, in case of a dimple 6 having a triangular plane shape, the contour length x is the total length of the three sides. Because these sides are present on a spherical surface, the sides are strictly not straight but circular-arc. The length of this arc accounts for the length of the side. Furthermore, in case of a circular dimple, the contour length x is calculated by the following formula.

$x=D\times\pi$ (wherein D is a diameter of the dimple)

In view of the flight performance, total volume of the dimples is preferably in the range from 430 $mm^3$ to 630 $mm^3$. When the total volume of the dimples is below the range described above, hopping trajectory may be yielded, and thus the travel distance may be insufficient. In this respect, the total volume of the dimples being greater than or equal to 450 $mm^3$ is particularly preferred. When the total volume of the dimples is beyond the range described above, dropping trajectory may be yielded, and thus the travel distance may be insufficient. In this respect, the total volume of the dimples being less than or equal to 610 $mm^3$ is more preferred, and less than or equal to 560 $mm^3$ is particularly preferred. The total volume of the dimples means a summation of the volume of individual dimples 6. The volume of the dimple means the volume of a space surrounded by the surface of a dimple and a phantom spherical surface (i.e., a supposed surface of the golf ball 1 when the dimples 6 are assumed not to exist on the golf ball 1).

In light of the flight performance, surface area occupation ratio Y of dimples 6 is preferably in the range from 65% to 90%. When the surface area occupation ratio Y is below the range described above, primary effects by the dimples, which involve turbulent flow surrounding the golf ball 1 may be insufficient, and thus the travel distance may be diminished. In this respect, surface area occupation ratio Y is more preferably greater than or equal to 67%, and particularly preferably greater than or equal to 70%. When the surface area occupation ratio Y is beyond the range described above, hopping trajectory may be yielded, and thus the travel distance may be diminished. In this respect, the surface area occupation ratio Y is more preferably less than or equal to 88%, and particularly preferably less than or equal to 85%. The surface area occupation ratio Y means a percentage of the total area of the individual dimples 6 occupied in the entire surface area of the phantom spherical surface. The area of the individual dimple 6 refers to an area of a region surrounded by the outline of the dimple 6 upon observation of the center of the golf ball 1 viewed at infinity, namely the area of the plane shape of the dimple 6. In case of a circular dimple, the area S is calculated by the following formula.

$S=(D/2)^2\times\pi$ (wherein D is a diameter of the dimple)

The golf ball 1 having the core 2, the cover 3 and the dimples 6 designed as described above, achieves a long travel distance. Preferably, total distance as measured pursuant to ODS rules of USGA is greater than or equal to 285 yards, and particularly, greater than or equal to 290 yards.

EXAMPLES

[Molding of Core]

Example 1

A rubber composition was prepared by kneading 100 parts by weight of polybutadiene ("BR-1", trade name by JSR Corporation), 25 parts by weight of zinc acrylate, 23 parts by weight of zinc oxide, 1.0 part by weight of dicumyl peroxide, and 0.6 parts by weight of diphenyl disulfide in an internal kneading machine. This rubber composition was placed in a mold having a spherical cavity, kept at 160° C. for 25 minutes to obtain a core having a diameter of 38.0 mm.

Examples 2 to 6, Examples 8 to 11 and Comparative Examples 1 to 6

The cores for the golf balls of Examples 2 to 6, Examples 8 to 11 and Comparative Examples 1 to 6 were obtained with the formulation and under the crosslinking condition as illustrated in Table 1 and Table 2 below. To make sure, regarding Example 2 for example, the core was formed by keeping at 140° C. for 25 minutes, followed by elevating to 170° C. and keeping additional 10 minutes, what is called "two-stages crosslinking".

Example 7

The inner core layer was obtained with the blending and crosslinking condition illustrated in the column "inner core layer" in Table 1 below. Next, half shells were formed with the rubber composition that was blended as illustrated in the column "outer core layer" in Table 1 below, and thereafter, the two half shells were covered over the inner cover layer, subjected to a crosslinking reaction under the condition illustrated in the same column. The core for the golf ball of Example 7 was hereby obtained.

TABLE 1

| | | Cores according to Examples | | | | | | | | | | |
|---|---|---|---|---|---|---|---|---|---|---|---|---|
| | | Example 1 | Example 2 | Example 3 | Example 4 | Example 5 | Example 6 | Example 7 | Example 8 | Example 9 | Example 10 | Example 11 |
| Inner core layer | BR-01 | None (single layer) | None (single layer) | None (single layer) | None (single layer) | None (single layer) | None (single layer) | 100 | None (single layer) | None (single layer) | None (single layer) | None (single layer) |
| | Zinc acrylate | | | | | | | 25 | | | | |
| | Zinc oxide | | | | | | | 6.5 | | | | |
| | Dicumyl peroxide | | | | | | | 1 | | | | |
| | Diphenyl disulfide | | | | | | | 0.5 | | | | |
| | Diameter (mm) | | | | | | | 31.2 | | | | |
| | Stage 1 (° C.-min) | | | | | | | 142-25 | | | | |
| | Stage 2 (° C.-min) | | | | | | | 170-10 | | | | |
| | Amount of Compressive deformation (mm) | | | | | | | 4.20 | | | | |
| Outer core layer | BR-01 | 100 | 100 | 100 | 100 | 100 | 100 | 100 | 100 | 100 | 100 | 100 |
| | Tungsten powder | | | | | | | 19 | | | | |
| | Zinc acrylate | 25 | 25 | 23 | 30 | 25 | 28 | 30 | 21 | 25 | 25 | 25 |
| | Zinc oxide | 23 | 23 | 18 | 20 | 30 | 17 | 20 | 30 | 23 | 23 | 30 |
| | Dicumyl peroxide | 1.0 | 0.6 | 1.0 | 1.0 | 1.0 | 1.0 | 1.2 | 0.6 | 1.0 | 1.0 | 1.0 |
| | Diphenyl disulfide | 0.6 | | 0.6 | | 0.6 | 0.5 | 0.5 | 1.0 | 0.5 | 0.6 | 0.6 |
| | Pentachloro thiophenol | | | | 0.6 | | | | | | | |
| | Diameter (mm) | 38.0 | 38.0 | 40.2 | 38.6 | 36.6 | 34.8 | 38.2 | 35.6 | 38.0 | 38.0 | 36.6 |
| | Stage 1 (° C.-min) | 160-25 | 140-25 | 170-20 | 142-25 | 160-25 | 142-25 | 160-20 | 155-25 | 160-25 | 160-25 | 160-25 |
| | Stage 2 (° C.-min) | | 170-10 | | 170-10 | | 170-10 | | | | | |
| | Amount of Compressive deformation (mm) | 3.8 | 3.4 | 4.5 | 3.0 | 4.0 | 3.6 | 3.9 | 5.9 | 3.7 | 3.8 | 4.0 |

TABLE 2

| | | Cores according to Comparative Examples | | | | | |
|---|---|---|---|---|---|---|---|
| | | Comparative Example 1 | Comparative Example 2 | Comparative Example 3 | Comparative Example 4 | Comparative Example 5 | Comparative Example 6 |
| Inner Core Layer | | None (single layer) | None (single layer) | None (single layer) | None (single layer) | None (single layer) | None (single layer) |
| Outer core layer | IR2200 | 20 | | | | | |
| | BR-01 | 80 | 100 | 100 | 100 | 100 | 100 |
| | Zinc acrylate | 25 | 25 | 30 | 38 | 34 | 25 |
| | Zinc oxide | 23 | 23 | 20 | 14 | 17 | 23 |
| | Dicumyl peroxide | 0.6 | 1.0 | 0.5 | 1.0 | 0.9 | 1.0 |

TABLE 2-continued

| | Cores according to Comparative Examples | | | | | |
|---|---|---|---|---|---|---|
| | Comparative Example 1 | Comparative Example 2 | Comparative Example 3 | Comparative Example 4 | Comparative Example 5 | Comparative Example 6 |
| Diphenyl disulfide | | 0.6 | | | | 0.6 |
| Pentachloro thiophenol | | | | 0.6 | 1.0 | |
| Diameter (mm) | 38.0 | 38.0 | 38.6 | 39.6 | 40.2 | 38.0 |
| Stage 1 (° C.-min) | 160-25 | 160-25 | 142-25 | 142-25 | 150-30 | 160-25 |
| Stage 2 (° C.-min) | | | 170-10 | 170-10 | | |
| Amount of Compressive deformation (mm) | 3.8 | 3.8 | 3.0 | 2.4 | 2.8 | 3.8 |

[Molding of Cover]

Example 1

A resin composition was prepared by kneading 50 parts by weight of an ionomer resin ("IOTEK 7010" described above), 50 parts by weight of another ionomer resin ("IOTEK 8000" described above), and 3 parts by weight of titanium dioxide. On the other hand, the core was placed into a mold having a spherical cavity, and the resin composition that had been melted by heating was injected around this core. The cover for the golf ball of Example 1 (thickness: 2.4 mm) was hereby formed.

Examples 2 to 4, Example 7, Examples 9 to 10 and Comparative Examples 1 to 6

In a similar manner to Example 1 except that the resin composition was blended as illustrated in Table 3 and Table 4 below, the covers for golf balls of Examples 2 to 4, Example 7, Examples 9 to 10 and Comparative Examples 1 to 6 were formed.

Examples 5 to 6, Example 8 and Example 11

The core was placed into a mold having a spherical cavity, and the resin composition of which formulation illustrated in the column "inner cover layer" in Table 3 below was injected around this core to mold a inner cover layer having a thickness illustrated in the same column. Next, the resultant spherical body which comprises the core and the inner cover layer was placed into a mold having a spherical cavity, and the resin composition of which formulation illustrated in the column "outer cover layer" in Table 3 below was injected around this spherical body to mold a cover for the golf balls of Examples 5 to 6, Example 8 and Example 11.

TABLE 3

| | | Covers according to Examples | | | | | | | | | | |
|---|---|---|---|---|---|---|---|---|---|---|---|---|
| | | Example 1 | Example 2 | Example 3 | Example 4 | Example 5 | Example 6 | Example 7 | Example 8 | Example 9 | Example 10 | Example 11 |
| Inner cover layer | Surlyn 8945 | None (single layer) | None (single layer) | None (single layer) | None (single layer) | 35 | | None (single layer) | 35 | None (single layer) | None (single layer) | 35 |
| | Surlyn 9945 | | | | | 35 | | | 35 | | | 35 |
| | Hytrel 4047 | | | | | 30 | | | 30 | | | 30 |
| | ET880 | | | | | | 100 | | | | | |
| | Tungsten powder | | | | | | 16 | | | | | |
| | Shore D hardness | | | | | 58 | 30 | | | | | 58 |
| | Thickness (mm) | | | | | 1.5 | 1.6 | | 1.3 | | | 1.5 |
| Outer cover layer | Surlyn 8945 | | | | | | | | 20 | | | |
| | Surlyn 9945 | | | | | 50 | | | 20 | | | 50 |
| | Himilan 1605 | | 60 | 40 | 50 | 50 | 50 | 50 | | 50 | | 50 |
| | Himilan 1706 | | 40 | 40 | 50 | | 50 | 50 | | 50 | | |
| | Himilan 1855 | | | 20 | | | | | | | | |
| | IOTEK 7010 | 50 | | | | | | | 30 | | 50 | |
| | IOTEK 8000 | 50 | | | | | | | 30 | | 50 | |
| | Titanium dioxide | 3 | 3 | 3 | 3 | 3 | 3 | 3 | 3 | 3 | 3 | 3 |
| | Shore D hardness | 65 | 63 | 59 | 63 | 63 | 63 | 63 | 64 | 63 | 65 | 63 |
| | Thickness (mm) | 2.4 | 2.4 | 1.3 | 2.1 | 1.6 | 2.4 | 2.3 | 2.3 | 2.4 | 2.4 | 1.6 |

TABLE 4

| | | Covers according to Comparative Examples | | | | | |
|---|---|---|---|---|---|---|---|
| | | Comparative Example 1 | Comparative Example 2 | Comparative Example 3 | Comparative Example 4 | Comparative Example 5 | Comparative Example 6 |
| Inner cover layer | | None (single layer) | None (single layer) | None (single layer) | None (single layer) | None (single layer) | None (single layer) |
| Outer cover layer | Himilan 1605 | | 50 | 50 | 50 | | |
| | Himilan 1706 | | | | 50 | | |
| | Himilan 1855 | | 50 | 50 | | 50 | |
| | IOTEK 7010 | 50 | | | | | 50 |
| | IOTEK 8000 | 50 | | | | | 50 |
| | Himilan 1856 | | | | | 50 | |
| | Titanium dioxide | 3 | 3 | 3 | 3 | 3 | 3 |
| | Shore D hardness | 65 | 57 | 57 | 63 | 53 | 65 |
| | Thickness (mm) | 2.4 | 2.4 | 2.1 | 1.6 | 1.3 | 2.4 |

[Formation of Paint Layer]

Urethane paint was applied on the surface of the cover, and kept at an atmosphere of 45° C. for 4 hours to dry the paint. Thus, the golf ball of each of Examples and Comparative Examples was obtained.

[Data for Dimples]

Dimples were configured by way of protrusions disposed on the surface of the cavity of the mold during forming the cover as described above. The data for the dimples following the paint layer formation are illustrated in Table 5 and Table 6 below. All of the dimples, which were formed on the golf ball of each of Examples and Comparative Examples, are circular dimples. In Table 5 and Table 6, respective plural classes of dimples that were arranged on the golf balls are encoded alphabetically ("A", "B", - - - ) according to the order of the diameter length, from the longer to the shorter.

TABLE 5

| | Data of dimples according to Examples | | | | | | | | | | |
|---|---|---|---|---|---|---|---|---|---|---|---|
| | Example 1 | Example 2 | Example 3 | Example 4 | Example 5 | Example 6 | Example 7 | Example 8 | Example 9 | Example 10 | Example 11 |
| A Dimple: | | | | | | | | | | | |
| Diameter (mm) | 4.15 | 4.15 | 4.30 | 4.10 | 4.15 | 4.15 | 4.15 | 4.15 | 4.15 | 5.00 | 3.90 |
| Contour length (mm) | 13.04 | 13.04 | 13.51 | 12.88 | 13.04 | 13.04 | 13.04 | 13.04 | 13.04 | 15.71 | 12.25 |
| Number | 186 | 50 | 228 | 24 | 186 | 186 | 186 | 186 | 50 | 72 | 50 |
| B Dimple: | | | | | | | | | | | |
| Diameter (mm) | 4.05 | 3.80 | 3.80 | 3.80 | 4.05 | 4.05 | 4.05 | 4.05 | 3.80 | 4.20 | 3.70 |
| Contour length (mm) | 12.72 | 11.94 | 11.94 | 11.94 | 12.72 | 12.72 | 12.72 | 12.72 | 11.94 | 13.19 | 11.62 |
| Number | 48 | 210 | 108 | 216 | 48 | 48 | 48 | 48 | 210 | 24 | 180 |
| C Dimple: | | | | | | | | | | | |
| Diameter (mm) | 3.75 | 3.50 | 2.70 | 3.60 | 3.75 | 3.75 | 3.75 | 3.75 | 3.50 | 3.90 | 3.55 |
| Contour length (mm) | 11.78 | 11.00 | 8.48 | 11.31 | 11.78 | 11.78 | 11.78 | 11.78 | 11.00 | 12.25 | 11.15 |
| Number | 66 | 150 | 24 | 96 | 66 | 66 | 66 | 66 | 150 | 88 | 180 |
| D Dimple: | | | | | | | | | | | |
| Diameter (mm) | 3.55 | None | None | 3.35 | 3.55 | 3.55 | 3.55 | 3.55 | None | 3.70 | 2.80 |
| Contour length (mm) | 11.15 | | | 10.52 | 11.15 | 11.15 | 11.15 | 11.15 | | 11.62 | 8.80 |
| Number | 60 | | | 96 | 60 | 60 | 60 | 60 | | 158 | 50 |
| E Dimple: | | | | | | | | | | | |
| Diameter (mm) | 2.55 | None | None | None | 2.55 | 2.55 | 2.55 | 2.55 | None | None | None |
| Contour length (mm) | 8.01 | | | | 8.01 | 8.01 | 8.01 | 8.01 | | | |
| Number | 30 | | | | 30 | 30 | 30 | 30 | | | |
| Total dimple number | 390 | 410 | 360 | 432 | 390 | 390 | 390 | 390 | 410 | 342 | 460 |
| Number of dimples having a longer contour length | 300 | 260 | 336 | 240 | 300 | 300 | 300 | 300 | 260 | 342 | 230 |
| Percentage of dimples having a longer contour length (%) | 77 | 63 | 93 | 56 | 77 | 77 | 77 | 77 | 63 | 100 | 50 |

TABLE 5-continued

| | Data of dimples according to Examples | | | | | | | | | | |
|---|---|---|---|---|---|---|---|---|---|---|---|
| | Example 1 | Example 2 | Example 3 | Example 4 | Example 5 | Example 6 | Example 7 | Example 8 | Example 9 | Example 10 | Example 11 |
| Total dimple volume ($mm^3$) | 520 | 495 | 550 | 490 | 520 | 520 | 520 | 520 | 495 | 550 | 475 |
| Surface area occupation ratio (%) | 80.49 | 78.58 | 81.59 | 80.13 | 80.49 | 80.49 | 80.49 | 80.49 | 78.58 | 78.50 | 80.69 |

TABLE 6

| | Data of dimples according to Comparative Examples | | | | | |
|---|---|---|---|---|---|---|
| | Comparative Example 1 | Comparative Example 2 | Comparative Example 3 | Comparative Example 4 | Comparative Example 5 | Comparative Example 6 |
| A Dimple: | | | | | | |
| Diameter (mm) | 4.30 | 4.30 | 4.15 | 4.15 | 4.15 | 3.90 |
| Contour length (mm) | 13.51 | 13.51 | 13.04 | 13.04 | 13.04 | 12.25 |
| Number | 180 | 180 | 186 | 186 | 186 | 40 |
| B Dimple: | | | | | | |
| Diameter (mm) | 3.60 | 3.60 | 4.05 | 4.05 | 4.05 | 3.70 |
| Contour length (mm) | 11.31 | 11.31 | 12.72 | 12.72 | 12.72 | 11.62 |
| Number | 100 | 100 | 48 | 48 | 48 | 164 |
| C Dimple: | | | | | | |
| Diameter (mm) | 3.00 | 3.00 | 3.75 | 3.75 | 3.75 | 3.55 |
| Contour length (mm) | 9.42 | 9.42 | 11.78 | 11.78 | 11.78 | 11.15 |
| Number | 130 | 130 | 66 | 66 | 66 | 186 |
| D Dimple: | | | | | | |
| Diameter (mm) | None | None | 3.55 | 3.55 | 3.55 | 2.80 |
| Contour length (mm) | | | 11.15 | 11.15 | 11.15 | 8.80 |
| Number | | | 60 | 60 | 60 | 70 |
| E Dimple: | | | | | | |
| Diameter (mm) | None | None | 2.55 | 2.55 | 2.55 | None |
| Contour length (mm) | | | 8.01 | 8.01 | 8.01 | |
| Number | | | 30 | 30 | 30 | |
| Total dimple number | 410 | 410 | 390 | 390 | 390 | 460 |
| Number of dimples having a longer contour length | 180 | 180 | 300 | 300 | 300 | 204 |
| Percentage of dimples having a longer contour length (%) | 44 | 44 | 77 | 77 | 77 | 44 |
| Total volume of dimples ($mm^3$) | 470 | 470 | 520 | 520 | 520 | 520 |
| Surface area occupation ratio (%) | 79.45 | 79.45 | 80.49 | 80.49 | 80.49 | 78.79 |

[Evaluation of Golf Ball]

[Travel Distance Test]

A driver with a metal head was attached to a swing robot (True Temper Co.). Then, the golf ball was hit under the following three conditions:

Condition A, clubhead speed: 35 m/s;

Condition B, clubhead speed: 40 m/s;

Condition C, clubhead speed: 45 m/s.

Each of the golf balls was hit five times, and the travel distance was measured. The averages of the measurements are represented in the following Table 7 and Table 8. In Table 7 and Table 8, "Ball/club speed ratio" means a ratio of the golf ball speed immediately after hitting, to the clubhead speed just before hitting. "Launch angle" means a degree of trajectory track of the golf ball immediately after hitting on the basis of the horizontal direction. "Spin speed" means a rotational velocity of backspin of the golf ball immediately after hitting. Further, "Carry" means a distance from the hitting point to the fall point of the golf ball. Moreover, "Total" means a distance from the hitting point to the stop point of the golf ball.

[Evaluation of Feel at Impact]

Using a driver with a metal head, the golf ball was hit by 10 higher-class golfers and 10 average golfers. Then, impressions for the flight and the feel at impact were evaluated. Regarding the impressions for the flight, selections were made from the following four items:

A: good resilience with attaining superior flight;

B: no impression for resilience with attaining superior flight;

C: good resilience but inferior flight; and

D: bad resilience with inferior flight.

In addition, regarding the feel at impact, selections were made from the following four items:

A: soft and light with good resilience;

B: soft and favorable;

E: hard; and

F: heavy.

The items for which evaluation converged are represented in Table 7 and Table 8.

TABLE 7

Results of evaluation for Examples

| | | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|---|
| Weight (g) | | 45.3 | 45.3 | 45.3 | 45.3 | 45.3 | 45.3 | 45.3 | 45.3 | 45.3 | 45.3 | 45.3 |
| External diameter (mm) | | 42.75 | 42.75 | 42.75 | 42.75 | 42.75 | 42.75 | 42.75 | 42.75 | 42.75 | 42.75 | 42.75 |
| Amount of compressive deformation (mm) | | 2.8 | 2.6 | 2.9 | 2.5 | 3.1 | 2.9 | 3.1 | 3.3 | 2.8 | 2.8 | 3.1 |
| Shore D hardness of outermost layer | | 65 | 63 | 59 | 63 | 63 | 63 | 63 | 64 | 63 | 65 | 63 |
| Percentage of dimples having a longer contour length (%) | | 77 | 63 | 93 | 56 | 77 | 77 | 77 | 77 | 63 | 100 | 50 |
| USGA-IV (ft/s) | | 255.5 | 255.2 | 255.0 | 255.1 | 255.2 | 255.0 | 255.1 | 255.8 | 255.4 | 255.5 | 255.2 |
| Travel distance with a USGA method (yards) | | 295 | 293 | 286 | 293 | 294 | 289 | 292 | 294 | 294 | 282 | 281 |
| Condition A | Ball/club speed ratio | 1.447 | 1.446 | 1.446 | 1.447 | 1.447 | 1.446 | 1.447 | 1.446 | 1.446 | 1.447 | 1.447 |
| | Launch angle | 12.4 | 12.3 | 12.5 | 12.1 | 12.6 | 12.4 | 12.4 | 12.7 | 12.6 | 12.4 | 12.6 |
| | Spin speed (rpm) | 2800 | 2850 | 2900 | 3000 | 2700 | 2900 | 2800 | 2700 | 2750 | 2800 | 2700 |
| | Carry (yards) | 166 | 167 | 167 | 168 | 168 | 167 | 168 | 166 | 168 | 165 | 165 |
| | Total (yards) | 185 | 185 | 186 | 184 | 187 | 186 | 185 | 188 | 186 | 184 | 183 |
| Condition B | Ball/club speed ratio | 1.445 | 1.444 | 1.444 | 1.445 | 1.446 | 1.444 | 1.446 | 1.445 | 1.444 | 1.445 | 1.446 |
| | Launch angle | 10.9 | 10.8 | 10.8 | 10.7 | 11.0 | 10.8 | 10.9 | 11.1 | 11.0 | 10.9 | 11.0 |
| | Spin speed (rpm) | 2900 | 2900 | 3000 | 3100 | 2800 | 2900 | 2900 | 2700 | 2900 | 2900 | 2800 |
| | Carry (yards) | 198 | 198 | 197 | 198 | 199 | 198 | 199 | 198 | 198 | 195 | 196 |
| | Total (yards) | 220 | 219 | 220 | 218 | 221 | 220 | 220 | 221 | 218 | 217 | 217 |
| Condition C | Ball/club speed ratio | 1.443 | 1.442 | 1.442 | 1.443 | 1.444 | 1.443 | 1.443 | 1.442 | 1.442 | 1.443 | 1.444 |
| | Launch angle | 10.3 | 10.2 | 10.2 | 10.0 | 10.4 | 10.2 | 10.2 | 10.5 | 10.4 | 10.3 | 10.4 |
| | Spin speed (rpm) | 2900 | 3000 | 3000 | 3100 | 2800 | 3000 | 2900 | 2800 | 2900 | 2900 | 2800 |
| | Carry (yards) | 228 | 227 | 227 | 228 | 229 | 227 | 228 | 227 | 228 | 226 | 225 |
| | Total (yards) | 242 | 241 | 240 | 239 | 244 | 242 | 240 | 242 | 242 | 238 | 237 |
| Flight by average golfers | | A | A | B | A | A | A | A | A | A | C | C |
| Flight by senior golfers | | A | A | A | A | A | A | A | A | A | C | C |
| Feel at impact | | A | A | A | B | A | A | A | A | A | A | A |

TABLE 8

Results of evaluation for Comparative Examples

| | | Comparative Example 1 | Comparative Example 2 | Comparative Example 3 | Comparative Example 4 | Comparative Example 5 | Comparative Example 6 |
|---|---|---|---|---|---|---|---|
| Weight (g) | | 45.3 | 45.3 | 45.3 | 45.3 | 45.3 | 45.3 |
| External diameter (mm) | | 42.75 | 42.75 | 42.75 | 42.75 | 42.75 | 42.75 |
| Amount of compressive deformation (mm) | | 2.8 | 2.9 | 2.8 | 2.2 | 2.5 | 2.8 |
| Shore D hardness of outermost layer | | 65 | 57 | 57 | 63 | 53 | 65 |
| Percentage of dimples having a longer contour length (%) | | 44 | 44 | 77 | 77 | 77 | 44 |
| USGA-IV (ft/s) | | 253.5 | 253.4 | 253.8 | 254.8 | 253.3 | 255.5 |
| Travel distance with a USGA method (yards) | | 283 | 281 | 284 | 292 | 280 | 283 |
| Condition A | Ball/club speed ratio | 1.444 | 1.443 | 1.445 | 1.446 | 1.443 | 1.447 |
| | Launch angle | 12.4 | 11.9 | 11.8 | 11.5 | 11.4 | 12.4 |
| | Spin speed (rpm) | 2800 | 3100 | 3200 | 3200 | 3300 | 2800 |
| | Carry (yards) | 162 | 161 | 161 | 162 | 160 | 163 |
| | Total (yards) | 181 | 179 | 177 | 179 | 176 | 180 |

TABLE 8-continued

Results of evaluation for Comparative Examples

| | | Comparative Example 1 | Comparative Example 2 | Comparative Example 3 | Comparative Example 4 | Comparative Example 5 | Comparative Example 6 |
|---|---|---|---|---|---|---|---|
| Condition B | Ball/club speed ratio | 1.440 | 1.439 | 1.441 | 1.441 | 1.440 | 1.445 |
| | Launch angle | 10.9 | 10.7 | 10.7 | 10.5 | 10.4 | 10.9 |
| | Spin speed (rpm) | 2900 | 3100 | 3100 | 3200 | 3400 | 2900 |
| | Carry (yards) | 194 | 193 | 194 | 191 | 190 | 194 |
| | Total (yards) | 216 | 213 | 214 | 210 | 208 | 214 |
| Condition C | Ball/club speed ratio | 1.439 | 1.438 | 1.439 | 1.441 | 1.440 | 1.443 |
| | Launch angle | 10.3 | 10.0 | 9.9 | 9.8 | 9.8 | 10.3 |
| | Spin speed (rpm) | 3300 | 3200 | 3200 | 3300 | 3500 | 2900 |
| | Carry (yards) | 223 | 221 | 222 | 223 | 221 | 223 |
| | Total (yards) | 234 | 231 | 232 | 232 | 229 | 230 |
| Flight by average golfers | | D | D | D | C | D | C |
| Flight by senior golfers | | D | B | B | B | D | C |
| Feel at impact | | B | F | F | E, F | E, F | A |

As is apparent from Table 7 and Table 8, the golf ball of each of Examples is superior in regard to both flight and feel at impact. Accordingly, advantages of the present invention are clearly indicated by these results of evaluation.

The description herein above is merely for illustrative examples, and therefore, various modifications can be made without departing from the principles of the present invention.

What is claimed is:

1. A golf ball including a core comprising one or more layers formed by crosslinking a rubber composition, and a cover comprising one or more layers formed from a resin composition, wherein said golf ball has:

a diameter of from 42.67 mm to 42.85 mm;

an amount of compressive deformation of from 2.5 mm to 4.0 mm when measured with applying an initial load of 10 kgf to a final load of 130 kgf;

a Shore D hardness of the outermost layer of said cover being from 58 to 72;

a surface area occupation ratio Y, expressing the percentage of the spherical surface area of the golf ball occupied by dimples, being in the range of 78.50% to 88%; and a percentage of the number of dimples having a contour length of greater than or equal to 11.6 mm based on the total number of numerous dimples formed over the surface thereof of greater than or equal to 77%.

2. The golf ball according to claim 1 wherein the amount of compressive deformation of the core is in the range from 3.0 mm to 6.0 mm when measured with applying an initial load of 10 kgf to a final load of 130 kgf.

3. The golf ball according to claim 1 wherein at least one layer of the core is formed by crosslinking a rubber composition comprising: 100 parts by weight of a base rubber predominantly containing polybutadiene, from 15 parts to 40 parts by weight of a co-crosslinking agent predominantly containing a zinc salt or magnesium salt of acrylic acid or methacrylic acid; from 0.1 parts to 3.0 parts by weight of an organic peroxide; and 0.1 parts to 1.5 parts by weight of a sulfur compound.

4. The golf ball according to claim 3 wherein said sulfur compound is one or more compound selected from disulfides, thiophenols and thiocarboxylic acids, and metal salts thereof.

5. The golf ball according to claim 1 wherein the initial velocity in accordance with a flywheel method of said golf ball, which was measured pursuant to USGA rules, is greater than or equal to 255.0 ft/s.

6. The golf ball according to claim 1 wherein the total distance measured pursuant to ODS rules established by USGA is greater than or equal to 285 yards.

7. The golf ball according to claim 1 wherein the amount of compressive deformation is from 2.6 to 3.5 mm.

8. The golf ball according to claim 1 wherein the Shore D hardness of the outermost layer of said cover is from 61 to 70.

9. The golf ball according to claim 1 wherein the total number of dimples is in the range of from 200 to 600.

10. The golf ball according to claim 1 wherein the total number of dimples is in the range of from 360 to 450.

* * * * *